US008353181B2

(12) United States Patent
Rydlewicz

(10) Patent No.: US 8,353,181 B2
(45) Date of Patent: Jan. 15, 2013

(54) HEART SHAPED DIAMOND CUT HAVING HEARTS AND ARROWS PATTERN

(75) Inventor: Roni Rydlewicz, Brussels (BE)

(73) Assignee: Worldwide Diamond Trademarks Ltd. (CA)

( * ) Notice: Subject to any disclaimer, the term of this patent is extended or adjusted under 35 U.S.C. 154(b) by 0 days.

(21) Appl. No.: 11/744,528

(22) Filed: May 4, 2007

(65) Prior Publication Data

US 2008/0271484 A1 Nov. 6, 2008

(51) Int. Cl.
*A44C 17/00* (2006.01)

(52) U.S. Cl. ..... 63/32; D11/90

(58) Field of Classification Search ..... None
See application file for complete search history.

(56) References Cited

U.S. PATENT DOCUMENTS

D217,634 S * 5/1970 Bodner ..... D11/90
D373,551 S * 9/1996 Udko ..... D11/90
D567,137 S * 4/2008 Rydlewicz ..... D11/90
2003/0221452 A1* 12/2003 Morbidoni ..... 63/26

* cited by examiner

*Primary Examiner* — Jack W. Lavinder
(74) *Attorney, Agent, or Firm* — Baker & Hostetler LLP

(57) ABSTRACT

A heart shaped diamond possessing a hearts and arrows pattern characteristic comprising: six main crown facets symmetrically aligned relative to one another, with each of the six main crown facets having a straight edge in parallel alignment with a straight edge of another main crown facet disposed opposite thereto; six main pavilion facets aligned at a fixed given angle of approximately 60° to each other and having a symmetrical number of pavilion half facets such that the six main pavilion facets meet at a point corresponding to the symmetrical central of the diamond and a multiple number of crown star facets spaced apart from one another on the surface of the diamond. The pavilion half facets are arranged in pairs polished on the main pavilion facet with a first pavilion half facet in each pair lying at a first angle of preferably 26.25° relative to a second pavilion half facet in the same pair and with the second pavilion half facet in each pair cut at a second angle of preferably 33.75° relative to the first pavilion half facet in an adjacent pair with which it shares a common boundary.

11 Claims, 9 Drawing Sheets

HEART SHAPED DIAMOND CUT HAVING HEARTS AND ARROWS PATTERN

FIELD OF THE INVENTION

The present invention relates to the field of cut diamonds and more particularly to a heart shaped diamond with its facets cut to generate a hearts and arrows pattern characteristic when exposed to light comparable to the hearts and arrows pattern generated by an ideal round cut diamond.

BACKGROUND OF THE INVENTION

A hearts and arrows pattern is successfully generated from within a round cut diamond when exposed to light provided the round diamond was cut into a nearly perfect round shape possessing equal and symmetrically cut facets with its angular proportions satisfying relatively narrow ranges as taught below in Table I. The symmetry of a near perfect round cut diamond provides brilliance, color and optical light handling properties which, to date, no other shaped diamond has been able to match. Although diamonds are typically cut into many different geometrical shapes other than round such as, for example, a heart shape, oval, pear, marquis, princess, emerald, etc., only the round cut diamond has a nearly perfect symmetrical shape. For this reason, it was assumed, in the past, that a hearts and arrows pattern was a characteristic limited to the round shape and even then only when cut into a nearly perfect symmetrical shape with all facets of equal size and depth and cut at equal angle degrees. Contrary to conventional thinking the heart shaped diamond has a shape so irregular and non-round no one skilled in the art would have considered it possible to cut a heart shaped diamond and yield a hearts and arrows pattern when exposed to light.

In a round cut diamond the hearts and arrows pattern appears only when the requirements for its cut facets, angle parameters and alignment relationships are as shown in the following Table 1:

TABLE 1

| | |
|---|---|
| The shape of the diamond is perfectly symmetrical | |
| 8 main crown and 24 subsidiary crown facets | |
| 8 main bottom and 16 subsidiary bottom facets | |
| All main facets (crown & bottom) have to be polished at a perfect 45° angel to each other | |
| All facets are perfectly aligned | |
| All the bottom main facets are of equal size and at an angle ranging from 40.6°-41.0° | |
| All the bottom subsidiary facets are of equal size and at an angel which is exactly 1.2° steeper than the main facets (main bottom angle 40.6°-41.0° + subsidiary 41.8°-42.2°) | |
| All the main crown facets are of equal size and at an angle ranging from 33.8°-35.1°. They have to be perfectly aligned on the main bottom facets. | |
| All the subsidiary crown facets are of equal size and perfectly aligned on the main crown and subsidiary bottom facets and polished at an equal angle. | |
| The ideal cut proportions are: | total depth 59.4%-62.4% |
| | crown height 14.5%-16.0% |
| | girdle thickness 1.5%-2.95% |
| | Roundness 99.0%-100% |
| | Table size: 53.0%-57.5% |

SUMMARY OF THE INVENTION

The heart shaped diamond, in accordance with the present invention, when exposed to light, displays a hearts and arrows pattern characteristic of the hearts and arrows pattern in a round diamond and comprises: six main crown facets symmetrically aligned relative to one another, with each of the six main crown facets having a straight edge in parallel alignment with a straight edge of another main crown facet disposed opposite thereto; six main pavilion facets aligned at a fixed given angle of approximately 60° to each other and having a symmetrical number of pavilion half facets such that the six main pavilion facets meet at a point corresponding to the symmetrical central of the diamond, a girdle and a table facet The heart shaped diamond further comprises a multiple number of crown star facets spaced apart from one another on the surface of the diamond with each of the crown star facets being small in size relative to the size of the main crown facets. Another highly preferred attribute of the heart shaped diamond of the present invention is to have the pavilion half facets arranged in pairs with each pair having a first and second pavilion half facet polished on a main pavilion facet with the first pavilion half facet in each pair lying at a precise first angle of preferably 26.25° relative to the second pavilion half facet in the same pair and with the second pavilion half facet in each pair cut at a precise second angle of preferably 33.75° relative to the first pavilion half facet in an adjacent pair with which the second pavilion half facet shares a common boundary. It is further preferred that the crown halves be cut at an angle of between 3.8° and 4.6° steeper than the angle of the main crown facets and that the pavilion half facets should not exceed ¾ of the length of the main pavilion facet measured from the common center of the diamond to the diamond girdle. Moreover, the distance between each of the pavilion half facets and the common point of the diamond should be identical.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

Figure 1A:
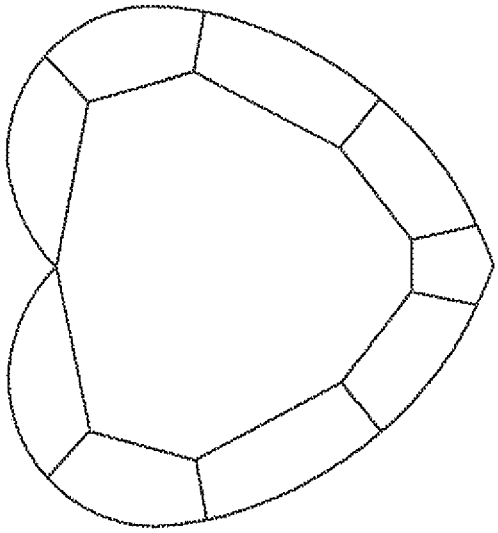
FIG. 1A (Prior Art)
FIG. 1A-1 E are top views of the traditionally cut prior art heart shaped diamond with FIG. 1A showing the main crown facets.
Figure 1B:
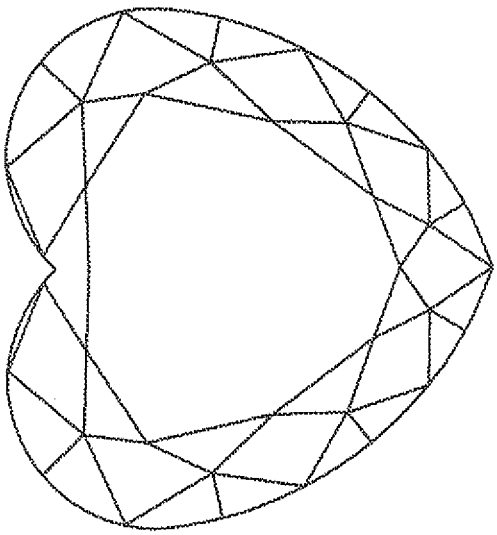
FIG. 1B (Prior Art)
FIG. 1B showing crown halves and crown stars, FIG. 1C showing the main pavilion facets, FIG. 1D showing multiple pavilion half facets polished on the main pavilion facets and FIG. 1E showing the butterfly effect on a traditional heart shaped diamond viewed from the table facet side.
Figure 1C:
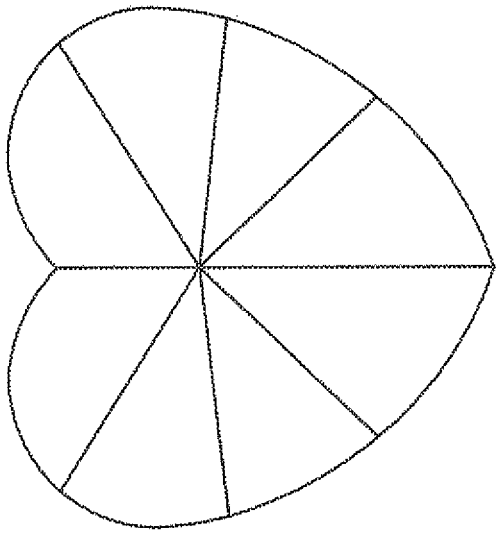
FIG. 1C (Prior Art)
Figure 1D:
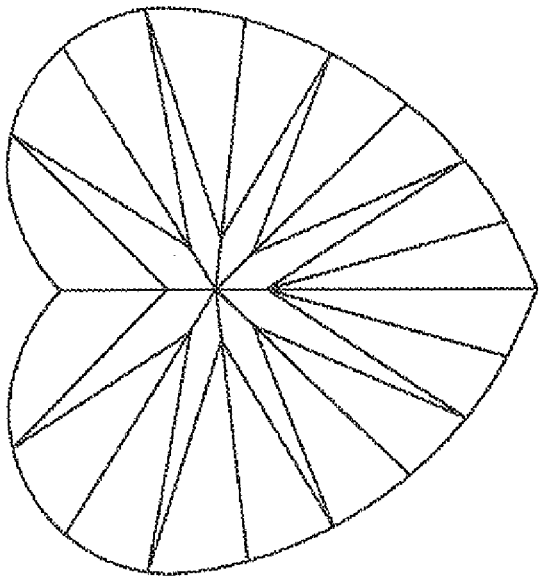
FIG. 1D (Prior Art)
Figure 1E:
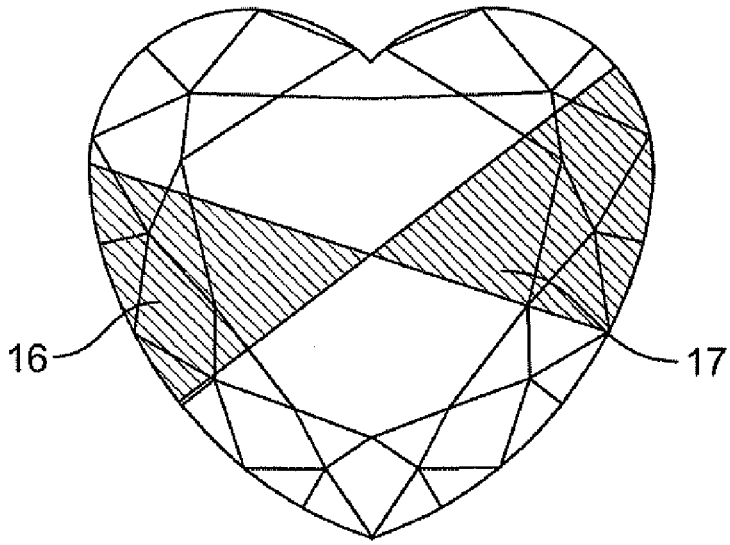
FIG. 1E (Prior Art)

A diamond is a crystal which functions as a prism for dispersing light by means of reflection and refraction. The heart shaped cut diamond 10 of the present invention is compared to the traditional cut heart shaped diamond in FIGS. 1-7B with FIGS. 1A-1E showing different views of a traditional cut heart shaped diamond. It is customary for the traditional heart shaped diamond to include 8 main crown facets and one subsidiary crown facet in the upper crown portion of the diamond as shown in FIG. 1A and a plurality of crown halves and crown stars as shown in FIG. 1B. In addition the traditional heart shaped diamond has 8 main pavilion facets as shown in FIG. 1C and a symmetrical number of pavilion halves as shown in FIG. 1D.

Figure 3:
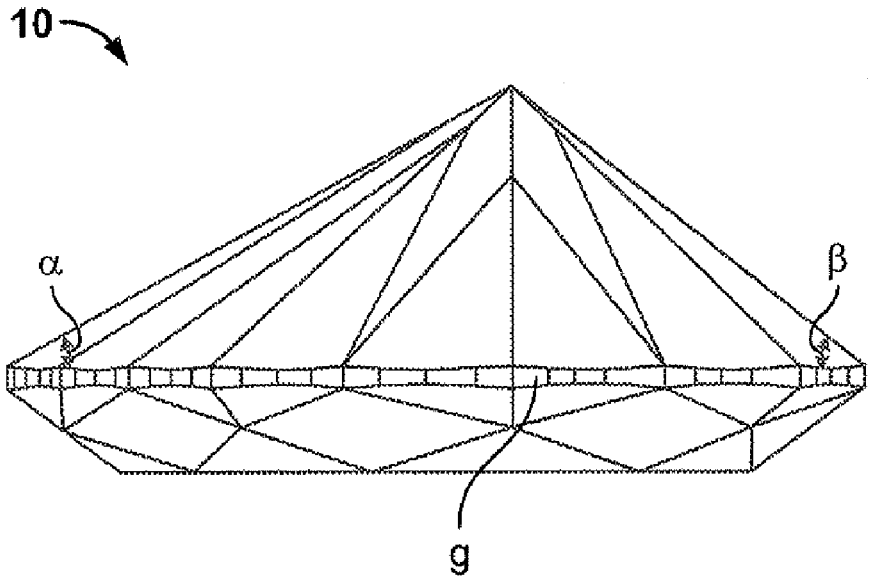
FIG. 3 is a side profile view of the traditional prior art cut heart shaped diamond.

FIG. 3 is a side profile view of the traditional heart shaped diamond showing the point of convergence of the pavilion facets (more typically referred to as the culet 11) offset from the center of the diamond. Moreover, in the traditional heart shaped diamond the girdle "g" is essentially equal in thickness throughout the diamond. The position, angle degree and alignment of the facets of the traditional heart shaped diamond are in line with the shape of the heart and are therefore not symmetrical in terms of positioning, alignment, size, angle degree and depth. The traditional heart shaped diamond has its facets polished ("cut") with different angle degrees to provide an off center culet and an equal girdle thickness throughout. This yields what is known in the diamond trade as a "butterfly effect", shown in FIG. 1E, such that when viewing the traditional heart shaped diamond in the presence of light through the table facet 15 on the side of the girdle "g" opposite the upper crown portion of the diamond one sees dark patches 16 and 17 in the left and right center area of the diamond.

A heart shaped diamond is traditionally constructed to satisfy the requirements in the following Table II:

TABLE II

| |
|---|
| 8 Main Pavillion facets aligned with the shape of the stone and, as such, they are asymmetrical and cause the angle degrees between all Main Pavillion facets to differ significantly |
| 18 Pavillion halves with differing angle degrees |
| 9 Main Crown facets that are not aligned on each other |
| 18 Crown halves with differing angle degrees |
| 9 Crown Star facets of differing angles, sizes and depths |
| The pavilion facets are cut within the angle degree range of 32°-38° |
| The crown facets are cut within the angel degree range of 30°-38.5° |
| The traditional head-shaped diamond is cut with low (flat) crown and pavilion angle facets yielding a Total Depth between 52%-60%. |
| The curves of crown and pavilion facets are not polished parallel to the longitude axis of the stone, but are cut more towards the point to bring the shape of the table in agreement with the contour of the stone. |
| The point of the diamond (culet) is not in the centre of the stone. |

The heart shaped diamond of the present invention was developed to yield a hearts and arrows pattern by disregarding the asymmetrical shape of the heart and the presence of a groove 14 inherently formed between two main crown facets in a heart cut diamond. The heart shaped diamond of the subject invention is limited to only 6 main crown facets to reduce the impact of the groove in the diamond and 6 main pavilion facets symmetrically aligned at a fixed given angle of approximately 60° to each other with a symmetrical number of pavilion half facets i.e. 12 polished perfectly symmetrical pavilion half facets on the 6 main pavilion facets with identical angle degree and height. In fact, the six main pavilion facets should be symmetrically arranged so that they converge at a point or culet corresponding to the symmetrical central of the diamond as opposed to being off centered as in the traditional heart shaped diamond.

Figure 4A:
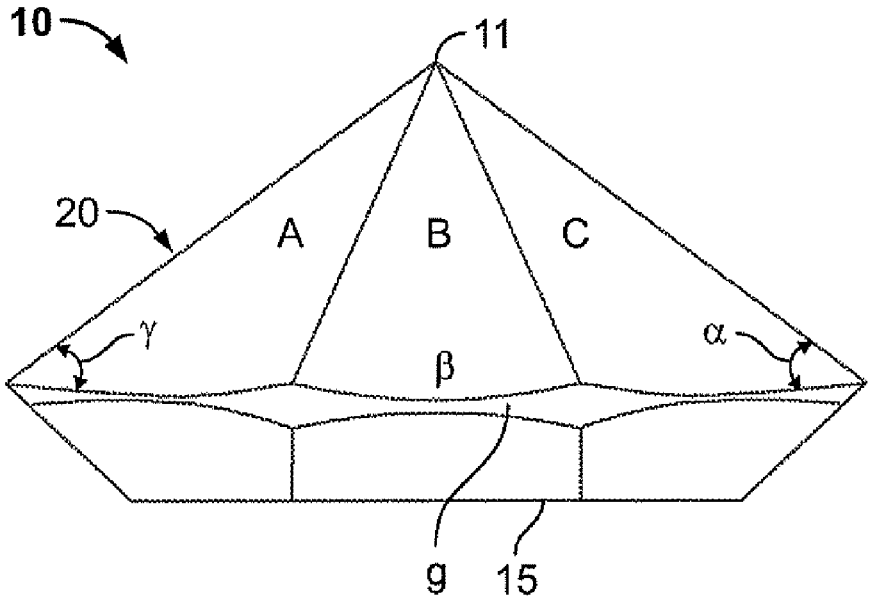
FIG. 4A-4B are side profile views of the heart shaped diamond of the subject invention with FIG. 4A showing the main pavilion facets and FIG. 4B showing the pavilion half facets polished on the main pavilion facets.
Figure 4B:
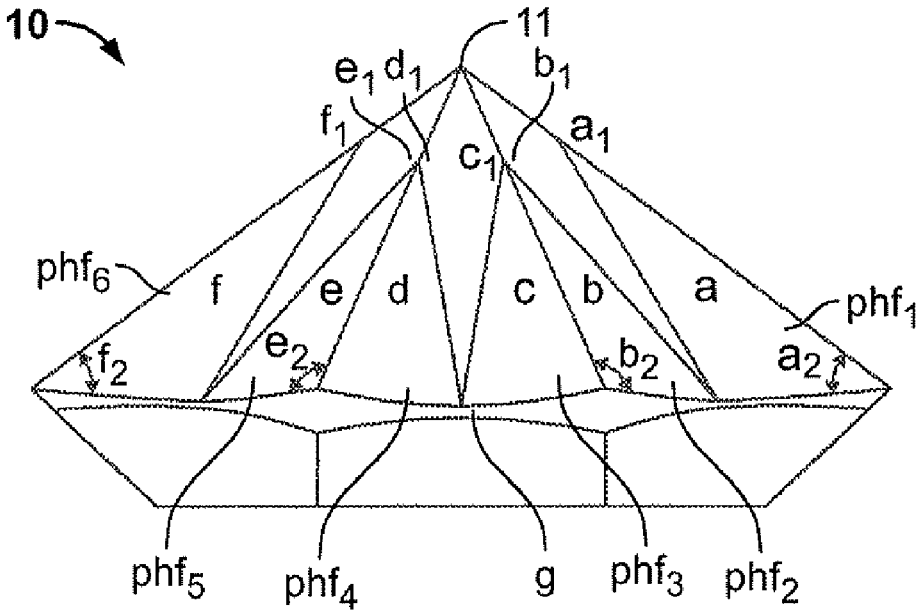

The heart shaped diamond is shown by various top views in FIGS. 2A-2E and in FIGS. 4A-4B inclusive and includes an upper crown portion 20 comprising 6 main crown facets ($cf_1$-$cf_6$), 6 main pavilion facets ($pf_1$-$pf_6$), 12 pavilion half facets ($phf_1$-$phf_{12}$), a plurality of crown halve facets, designated ("ch"), and a plurality of crown star facets, designated ("cs"), as is shown in FIG. 1B, a girdle (g) and a table facet 15 located on the side of the girdle (g) opposite the upper crown portion 20 as shown in FIG. 4A. The girdle (g) separates the upper crown portion 20 from the table facet 15 and is unequal and non-uniform in thickness throughout the diamond. The girdle (g) should preferably have a centrally located belly area BA as shown in FIG. 4A which is thicker than the thickness of the point area PA which constitutes the lower girdle area and thicker than the shoulder area SA causing the girdle thickness to vary throughout the diamond.

Figure 2A:
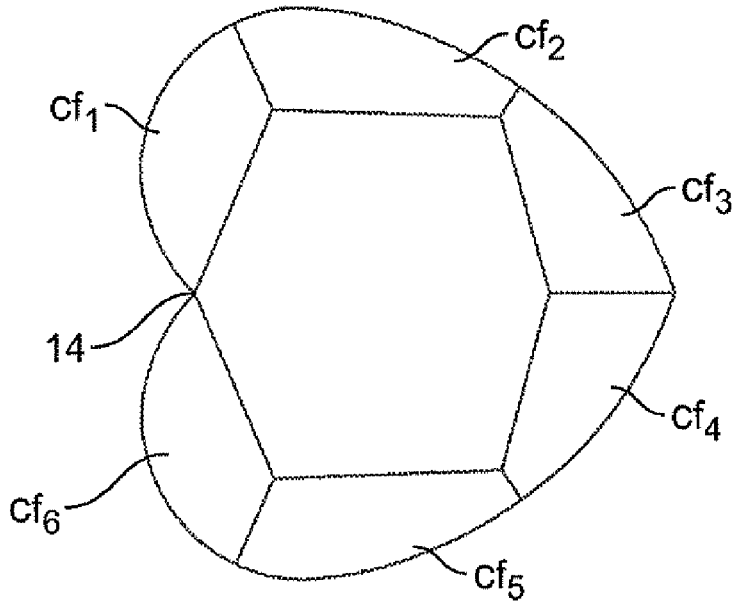
FIG. 2A-2E are top views of the heart shaped diamond of the subject invention with FIGS. 2A-2D comparative to FIGS. 1A-1D and with FIG. 2A showing the main crown facets, FIG. 2B showing crown halves and crown stars, FIG. 2C showing the main pavilion facets, FIG. 2D showing multiple pavilion half facets polished on the main pavilion facets and with FIG. 2E being an enlarged version of FIG. 2D.
Figure 2B:
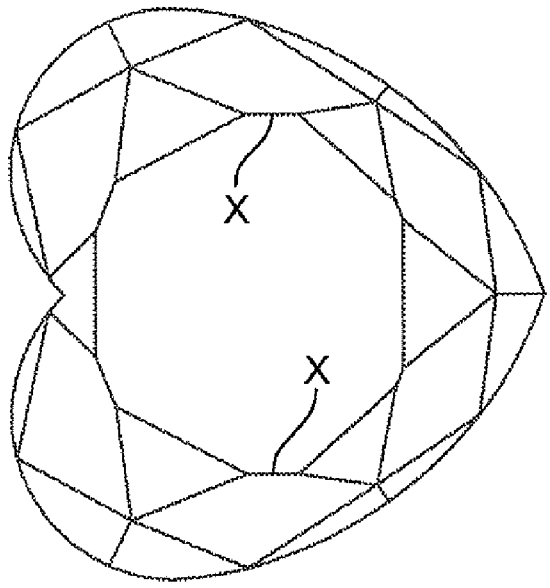
Figure 2C:
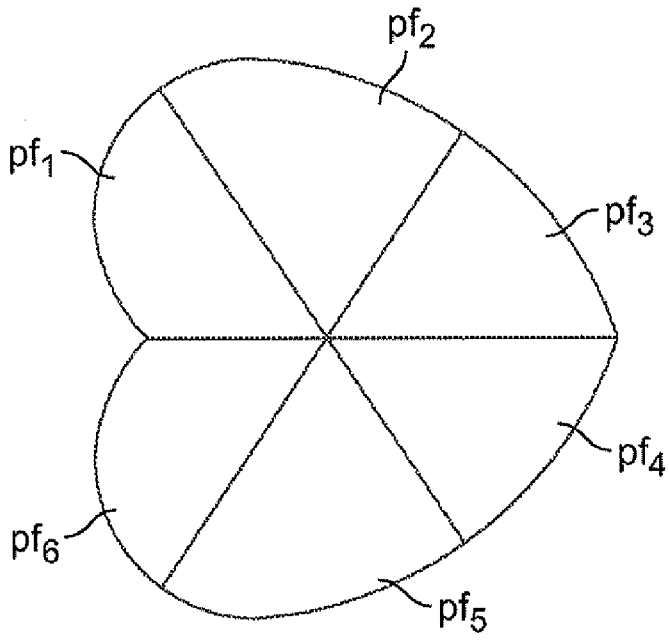
Figure 2D:
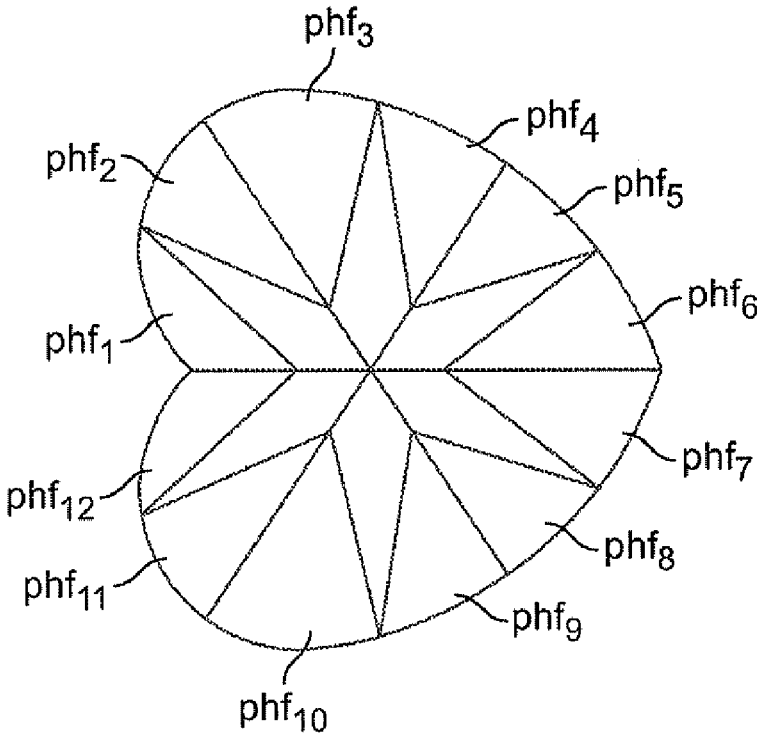

It should be noted that in the heart shaped diamond of the present invention the crown star facets (cs), as is shown in FIG. 2B, do not meet at a point on the surface of the diamond as is conventional in a traditional heart shaped cut diamond but instead are spaced apart a distance "x", forming an open area between adjacent main crown facets. This is considered important to the subject invention in that it permits light refraction to yield a hearts and arrows pattern on the heart shaped diamond. Moreover, the crown star facets should preferably cover only 66% to 82% of the distance of the main crown facets as observed through the table side of the diamond.

Three of the main pavilion facets, identified in FIG. 4A as A, B, C, for simplicity, demonstrate that the pavilion facets are equal in size, angle, degree and height. Moreover, all of the pavilion facets are polished at angle degrees $\alpha,\beta,\gamma$ preferably between 40.6° and 40.9°. FIG. 4B shows the pavilion half facets polished on the main pavilion facets with six of the pavilion half facets ($phf_1$-$phf_6$) shown as being identical in size, angle degree and height. In fact, all of the pavilion half facets are equal in size and have the same angle degree relative to the girdle (g). Furthermore, all of the pavilion half facets are equal in height and intersect the main pavilion facets at points $a_1$-$f_1$ such that the distance between the cutlet 11, corresponding to the symmetrical center of the diamond, and each of the points $a_1$-$f_1$ is identical. The pavilion halves should preferably be approximately ¾ of the height of the main pavilion facets.

Figure 2E:
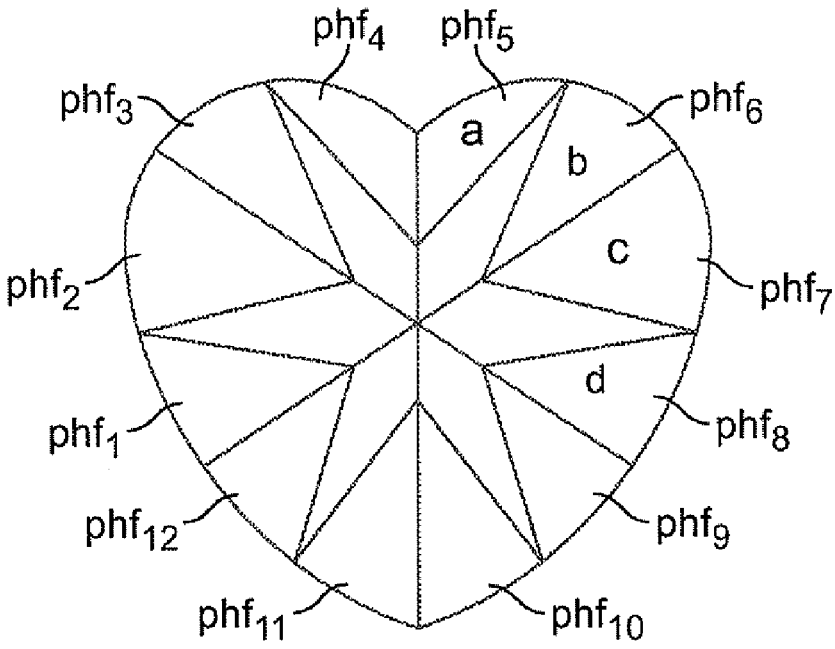

In addition, as is shown in FIG. 2E, the pavilion half facets ($phf_1$-$phf_{12}$) should be arranged in pairs having a first and second pavilion half facet, simply designated (a) and (b) in FIG. 2E, with each pair of pavilion half facets polished on a main pavilion facet such that pavilion half facet (a) is placed at 26.25° relative to pavilion half facet (b) in the same pair and with pavilion half facet (b) cut precisely at 33.75° relative to the next pavilion half facet (a) in an adjacent pair with which it shares a common boundary. Stated otherwise, the two pavilion half facets of each pair are placed on the same main pavilion facet and polished at the same angle degree relative to one another i.e. pavilion half facet (a) is placed at 26.25° relative to the pavilion half facet (b) in the same pair and pavilion half facet (b) is cut precisely at 33.75° relative to the next pavilion half facet (a) in an adjacent pair with which it shares a common boundary.

Figure 6A:
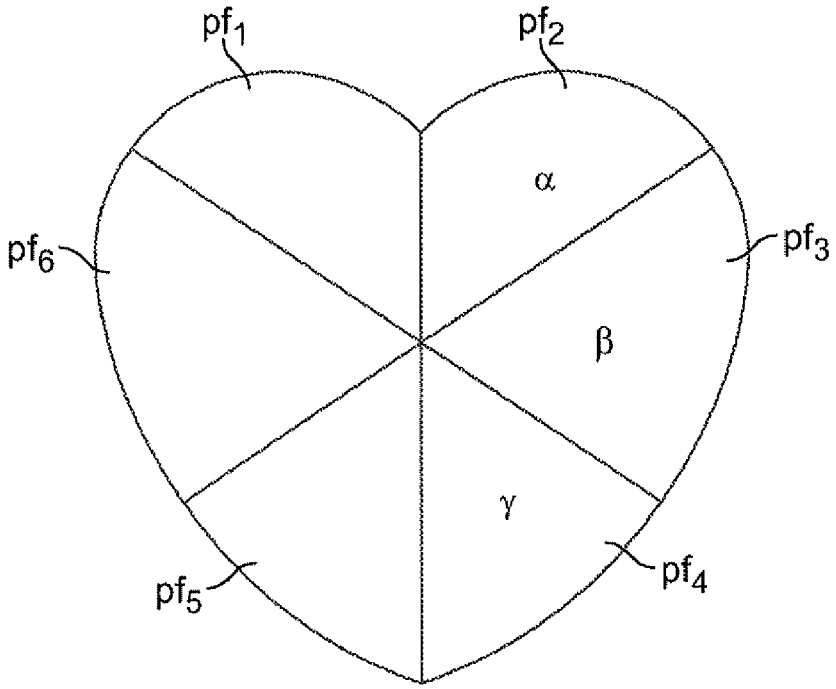
FIG. 6A-6B are comparative top views similar to FIG. 1C and FIG. 2C for demonstrating the differences between the main pavilion facets in the heart shaped diamond of the subject invention as shown in FIG. 6A and the main pavilion facets of the traditional cut heart shaped diamond as shown in FIG. 6B.
Figure 6B:
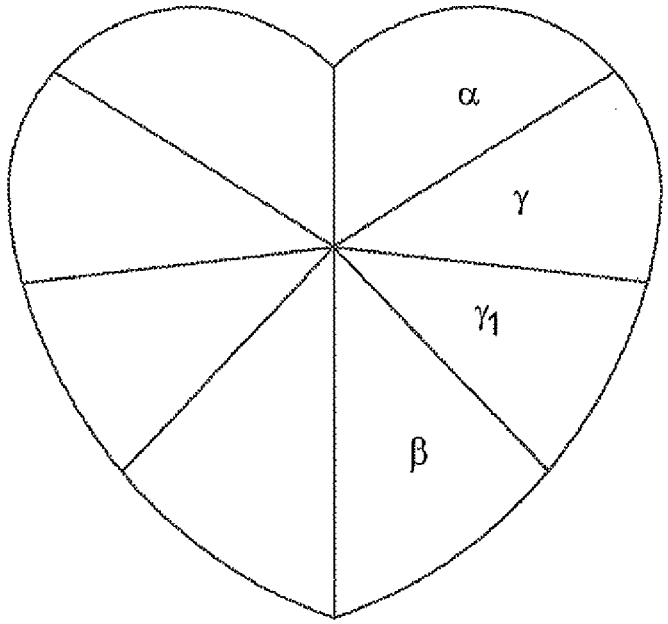

In the heart shaped diamond of the present invention all of the six main pavilion facets ($pf_1$-$pf_6$) are angularly aligned in a symmetrical relationship to one another as if in a circle at a fixed given angle of approximately 60° i.e., 360°/6=60° with each of the main pavilion facets cut, as explained above, at essentially the same angles where $\alpha=\beta=\gamma$ as is further shown in FIG. 6A and lie preferably between 40.6° and 40.9° thereby creating symmetry on an asymmetrical shape. This is in contrast to the traditional heart shaped diamond where the main pavilion angles $\alpha\neq\gamma$ and $\alpha_1\neq\beta$ as is shown in FIG. 6B.

Figure 5A:
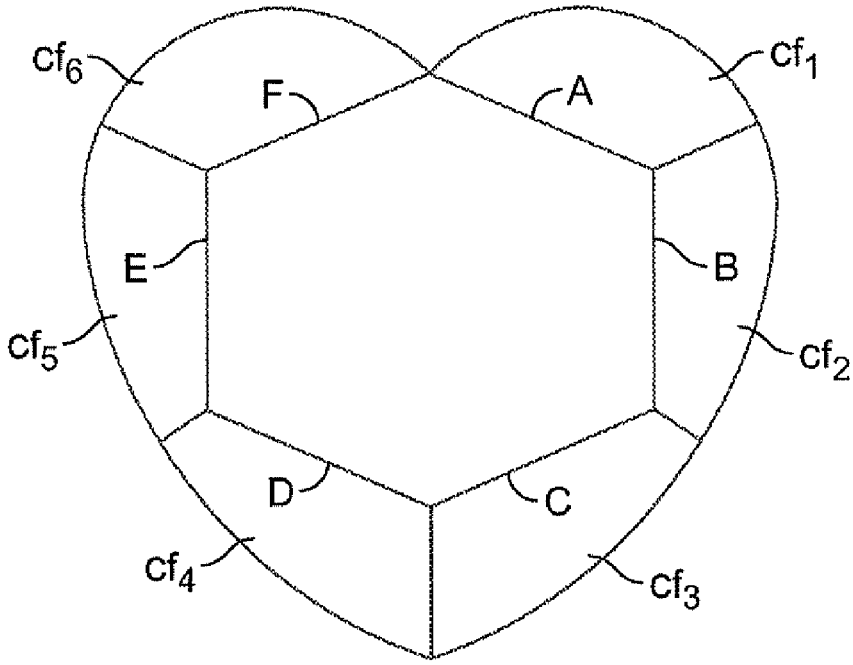
FIG. 5A-5B are comparative top views similar to FIG. 1A and FIG. 2A for demonstrating the differences between the main crown facets in the heart shaped diamond of the subject invention as shown in FIG. 5A and the main crown facets of the traditional cut heart shaped diamond as shown in FIG. 5B.
Figure 5B:
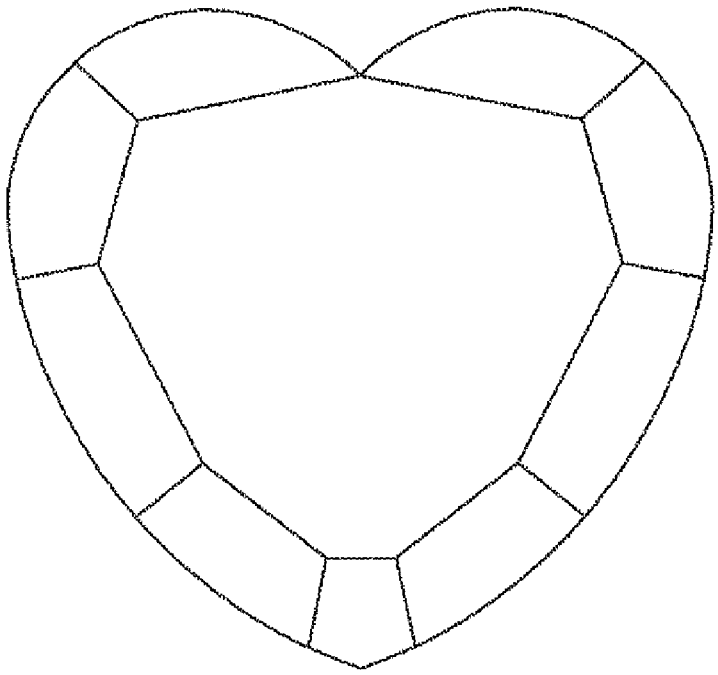

In addition, all of the six main crown facets ($cf_1$-$cf_6$) of the heart shaped diamond of the present invention have an edge which lies parallel to a corresponding edge of another main crown facet disposed opposite thereto as is shown in FIG. 5A where edge A is parallel to edge D, edge B is parallel to edge E and edge C is parallel to edge F. This is in contrast to the traditional heart shaped diamond as is shown in FIG. 5B where none of the main crown facets have an edge in parallel alignment with the edge of any other main crown facet.

Figure 7A:
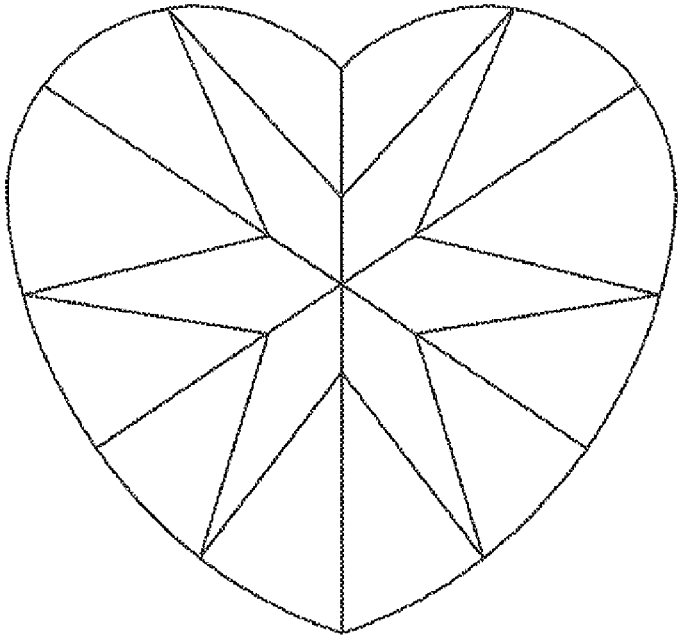
FIG. 7A-7B are comparative top views similar to FIG. 1D and FIG. 2D for demonstrating the differences between the pavilion halves in the heart shaped diamond of the subject invention as shown in FIG. 7A and the pavilion halves of the traditional cut heart shaped diamond as shown in FIG. 7B.
Figure 7B:
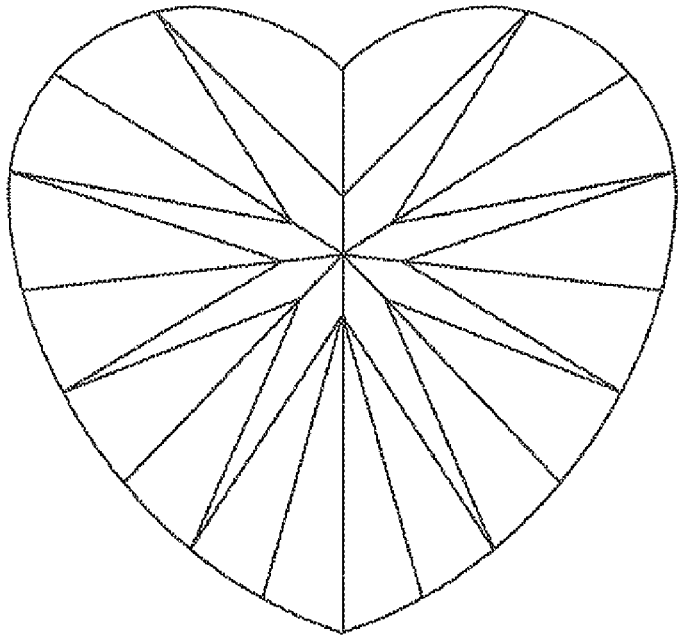

Moreover, in the heart shaped diamond of the present invention all of the pavilion halves are symmetrically polished on the main pavilion facets and at a preferred angle of between 42.2° and 42.3° as shown in FIG. 7A. This is in contrast to the traditional heart shaped diamond as is shown in FIG. 7B where all of the pavilion halves are polished at different angle degrees.

All of the preferred faceting and parameter requirements for the heart shaped diamond of the present invention are included in the following Table III:

TABLE III

| |
|---|
| 6 Main Pavillion facets, aligned with each other at a 60° angle, in order to create symmetry on an asymmetrical shape (360°/6 = 60°) |
| 6 Main Crown facets, aligned with each other and with the Main Pavilion facets. |
| All main pavilion facets have identical angle degrees (ranging from 40.6°-40.9°) |
| All main pavilion facets have identical size and depth |
| Every Main Grown facet has a perfectly parallel opposite main crown facet |
| Each Main Pavillion facet has a perfectly parallel opposite main pavilion facet |
| Point of the diamond (culet) is perfectly central, a maximum tolerance of 2% is allowed |
| Main Pavillion facets are all polished at an exact 60° from the neighbouring main pavilion facets |
| Main Crown facets are all polished at an exact 60° angle from the neighbouring main crown angles |
| Pavillion halves have to be of identical angle degree, size and height |
| Crown halves have to be polished at an angle degree of 3.8°-4.6° steeper than the main crown facets |
| Pavillion halves should not exceed ¾ of the length of the main pavilion facet |
| Crown Star facets have to be small and should cover only 66%-82% of the distance of the Main Grown facets as observed through the table. The traditional Heart shape is cut with star facets touching each other on the table facet |
| The main pavilion facets are perfectly aligned with the main crown facets |
| Two Pavillion halves facets that are polished on a Main Pavillion facet should be polished at precisely 26.25° from one another |
| Two Pavilion halves facets situated on a neighbouring main Pavillion facets should be polished at precisely 33.75° from one another |

| Parameters to achieve optimum H&A pattern on a heart-shaped diamond: | |
|---|---|
| Total Depth | 59.5%-62.4% |
| Pavillion Depth | 43.6%-45.4% |
| Main Pavillion Angle | 40.6°-40.9° |
| Crown Depth | 14.5%-16.2% |

TABLE III-continued

| | |
|---|---|
| Main Crown angle | 33.8°-35.2° |
| Pavillion halves | 42.2°-42.9° |
| Table Size | 53.5%-57.8% |
| Position of Culet (point of the diamond) must be central: | the tolerance should be less than 2% |
| Crown Halves | 33.7°-39.8° (or 3.8°-4.6° steeper than main crown angle) |
| Crown stars | 17.4°-21.6° (or 14.4°-17.8° flatter than main crown angle) |

What is claimed is:

1. A heart shaped diamond of asymmetrical shape which when exposed to light displays a hearts and arrows pattern substantially equivalent to the hearts and arrows pattern in a round diamond comprising; an even number of main crown facets with all of the main crown facets symmetrically aligned and polished to form essentially identical angels based upon dividing 360° by the number of main crown facets so that the main crown facets are symmetrically arranged around the asymmetrical shape, with each of the main crown facets having a straight edge in parallel alignment with a straight edge of another main crown facet disposed opposite thereto; a corresponding equal number of main pavilion facets, a symmetrical number of pavilion half facets such that the main pavilion facets meet at a point corresponding to the symmetrical central of the diamond, and further comprising: a plurality of crown half facets, a girdle which is non-uniform and has a substantially unequal thickness throughout the diamond, a table facet, and a multiple number of crown star facets spaced a substantial distance apart from one another on the surface of the diamond in an arrangement surrounding the table facet such that the crown star facets are unable to make contact with one another on the surface of the diamond and with the space formed between the crown star facets exposing the adjacent main crown facets directly to the table facet.

2. A heart shaped diamond as defined in claim 1 wherein the pavilion half facets are arranged in pairs with each pair having a first and second pavilion half facet polished on a main pavilion facet with the first pavilion half facet in each pair lying at a precise first angle relative to the second pavilion half facet in the same pair and with the second pavilion half facet in each pair cut at a precise second angle relative to the first pavilion half facet in an adjacent pair with which the second pavilion half facet shares a common boundary.

3. A heart shaped diamond as defined in claim 2 wherein each of the main pavilion facets are cut at essentially the same angles.

4. A heart shaped diamond as defined in claim 3 wherein the crown half facets are cut at an angle of between 3.8° and 4.6° steeper than the angle of the main crown facets.

5. A heart shaped diamond as defined in claim 2 wherein the pavilion half facets have a length equal to or smaller than ¾ of the length of the main pavilion facet measured from the common center of the diamond to the diamond girdle.

6. A heart shaped diamond as defined in claim 5 wherein the distance between each of the pavilion half facets and the common point of the diamond is identical.

7. A heart shaped diamond as defined in claim 2 wherein each of the crown star facets are small in size relative to the size of the main crown facets.

8. A heart shaped diamond as defined in claim 7 wherein the crown star facets cover only 66% to 82% of the distance of the main crown facets as observed through the table side of the diamond.

9. A heart shaped diamond as defined in claim 1 having six main crown facets and six main pavilion facets aligned at a fixed given angle of approximately 60° to one another.

10. A heart shaped diamond as defined in claim 9 wherein the first angle formed between the first pavilion half facet in each pair and the second pavilion half facet in the same pair is 26.25° and the second angle formed between the second pavilion half facet in each pair cut and the first pavilion half facet in an adjacent pair with which the second pavilion half facet shares a common boundary is 33.75.

11. A heart shaped diamond as defined in claim 10 wherein each of the main pavilion facets are cut at between 40.6° and 40.9°.

* * * * *